US006592917B2

(12) United States Patent
Yoon

(10) Patent No.: US 6,592,917 B2
(45) Date of Patent: Jul. 15, 2003

(54) COOKIE PACKING CONTAINER HAVING HANGER

(75) Inventor: Young Dal Yoon, Seoul (KR)

(73) Assignee: Crown Confectionery Co., Ltd., Seoul (KR)

( * ) Notice: Subject to any disclaimer, the term of this patent is extended or adjusted under 35 U.S.C. 154(b) by 214 days.

(21) Appl. No.: 09/877,051

(22) Filed: Jun. 11, 2001

(65) Prior Publication Data

US 2002/0102335 A1 Aug. 1, 2002

(30) Foreign Application Priority Data

Jan. 30, 2001 (KR) ..... U.M. 2001-2116
Feb. 15, 2001 (KR) ..... U.M. 2001-3829

(51) Int. Cl.[7] ..... B65D 33/10; B65D 33/06

(52) U.S. Cl. ..... 426/110; 426/115; 426/122; 426/128; 224/607; 383/13; 383/24; 383/200; 383/209; 383/906; 383/907

(58) Field of Search ..... 426/110, 115, 426/122, 128; 383/13, 17, 24, 26, 200, 202, 209, 906, 907; 224/220, 267, 607, 616

(56) References Cited

U.S. PATENT DOCUMENTS 1,470,334 A * 10/1923 Stensgaard et al.
3,212,679 A * 10/1965 Schmidt, Jr.
3,220,610 A * 11/1965 Specketer
3,387,701 A * 6/1968 Schneider et al.
3,429,495 A * 2/1969 McClosky
3,830,270 A * 8/1974 Hagert et al.
4,733,807 A * 3/1988 Porter et al.
4,911,562 A * 3/1990 Mazzeschi
4,915,278 A * 4/1990 Smith
5,611,626 A * 3/1997 Warr
6,123,240 A * 9/2000 Fowles et al.
6,202,904 B1 * 3/2001 Casciano
6,206,571 B1 * 3/2001 Olin
6,299,044 B1 * 10/2001 Klindworth-Garron
6,318,626 B1 * 11/2001 St. Pierre et al.
6,443,338 B1 * 9/2002 Giacona, III

FOREIGN PATENT DOCUMENTS

| | | | |
|---|---|---|---|
| DE | 4445729 | * | 6/1996 |
| GB | 2259904 | * | 3/1993 |
| JP | 7-285562 | * | 10/1995 |
| JP | 10-167290 | * | 6/1998 |
| JP | 10-338249 | * | 12/1998 |
| JP | 11-43160 | * | 2/1999 |

* cited by examiner

*Primary Examiner*—Steve Weinstein
(74) *Attorney, Agent, or Firm*—Rosenberg, Klein & Lee

(57) ABSTRACT

A cookie packing container having a hanger to allow a user to eat the contents contained in the packing container, which is provided with an improved structure of a packing container for packing cookies and a hanging tape for allowing a user to hang the packing container in the neck, to thereby allow a user to eat the contents conveniently. The cookie packing container includes a packing container having a longitudinal seaming portion formed by using a planar packing sheet and seaming one end of the packing sheet to thereby contain cookies therein, a low-end seaming portion formed by seaming the lower end of the packing sheet and an upper-end seaming portion formed by seaming the upper-end of the packing sheet and sharpening the upper-end seaming portion to form a peak portion, and a hanger combined in one end of the packing container, for hanging the packing container in the neck.

8 Claims, 7 Drawing Sheets

COOKIE PACKING CONTAINER HAVING HANGER

BACKGROUND OF THE INVENTION

1. Field of the Invention

The present invention relates to a cookie packing container having a hanger, and more particularly, to a cookie packing container to allow a user to eat the contents contained in the packing container, which is provided with an improved structure of a packing container for packing cookies and a hanging tape for allowing a user to hang the packing container in the neck, to thereby allow a user to eat the contents in a simple and easy way.

2. Description of the Related Art

In general, a packing sheet for packing fried cookies is made of a polyethylene film, and a packing sheet shape and a packing method are determined considering the capacity and shape of the cookies contained.

In particular, fried cookies are made by frying starch as a main ingredient mixed with an addictive as a subordinate ingredient, in edible oil. Accordingly, the intensity of the fried cookies is very weak. Thus, the fried cookies are contained in a packing container and then the packing container is sealed with nitrogen gas and so on, in order to prevent the cookies from being damaged due to external impact thereon during transportation and distribution in the market.

Meanwhile, most cookies react upon oxygen in the air once a packing container containing the cookies is opened, and absorb moisture in the air to change in quality.

Therefore, a cookie packing container should be designed to pack an amount of cookies which can be eaten all at a time when it is opened.

An existing cookie packing container for satisfying the above conditions is formed by sealing the lower end of a rectangular double film and containing cookies therein to then seal the upper end thereof. Before sealing the upper end of the double film, nitrogen gas is filled therein as in the above-described example.

Also, since a durable material is used such as polyethylene resin and a sealing at the lower and upper ends of the double film is processed using a high frequency melting method, in order to prevent the nitrogen gas sealed packing sheet from being torn due to an external impact, the durable material would not be torn when it is opened. As a result, the polyethylene durable material should be cut using a tool such as a pair of scissors to open it well, which causes a problem that the cutting tool should be used.

Also, as shown in FIG. 7, an existing cookie packing container 5 has a rectangular structure in which the width is relatively shorter than the length. Accordingly, if the upper end is cut and opened to allow users to eat cookies and then the cookie packing container is inclined by mistake, the contents are apt to be poured out all at a time.

In particular, cookies each having a particle of 5 mm or so in diameter, should be picked up and eaten with the hand or a separate spoon. In the case that cookies are picked up and eaten with a spoon, the spoon should be prepared. In the case that cookies are picked up with the hand, the hand is stained with oil or crumbs which are soaked out from the cookies. In the case that the hand is dirty, the hand should be washed out or the hand cannot be used.

Also, since an existing cookie packing container is fabricated in the form of an envelop made of polyethylene resin, a shape-upkeep force, that is, a mechanical strength is weak. Thus, such an envelop-shape cookie packing container is laid down on a table or floor, which causes a problem that the contents in the packing container is poured out.

SUMMARY OF THE INVENTION

To solve the above problems, it is an object of the present invention to provide a cookie packing container having a peak portion formed on the upper end of the cookie packing container in which the peak portion is simply cut off, cookies can be picked up and eaten without using a separate tool or hand, and having a hanger formed on the cookie packing container in which the contents is eaten at a state where the cookie packing container is hanged in the neck, to thereby prevent the contents from pouring out.

To accomplish the above object of the present invention, there is provided a cookie packing container having a hanger comprising: a packing container having a longitudinal seaming portion formed by using a planar packing sheet and seaming one end of the packing sheet to thereby contain cookies therein, a low-end seaming portion formed by seaming the lower end of the packing sheet, and an upper-end seaming portion formed by seaming the upper-end of the packing sheet and sharpening the upper-end seaming portion to form a peak portion; and a hanger combined in the packing container, for hanging the packing container in the neck.

A cut-off portion is formed adjacent to the peak portion formed on the upper-end seaming portion, in order to allow a user to cut off the packing sheet simply. The peak portion formed in the upper-end seaming portion is formed on one side or the central portion of the packing container.

The hanger is seamed and fixed at the same time when the upper-end seaming portion or the longitudinal seaming portion is seamed, or connected and combined in a hanging hole formed in the upper-end seaming portion.

At least one coupling hole is formed in at least one portion of the longitudinal seaming portion and the upper-end seaming portion. The cookie packing container further comprises a ring connected to the coupling hole. The hanger is connected to the ring. The ring may be detachable from the coupling hole.

As described above, since the peak portion is formed on the upper end of the packing container, part of the peak portion is cut off when the contents are picked up and eaten, to thereby allow users to pick up and eat the contents simply without using a separate tool or hand, and since a hanger is provided in the cookie packing container, a user hangs the packing container in the neck during eating the contents conveniently to thereby allow a user to eat the cookies.

BRIEF DESCRIPTION OF THE DRAWINGS

The above object and other advantages of the present invention will become more apparent by describing the preferred embodiments thereof in more detail with reference to the accompanying drawings in which.

DETAILED DESCRIPTION OF THE INVENTION

Preferred embodiments of the present invention will be described with reference to the accompanying drawings.

Figure 1:
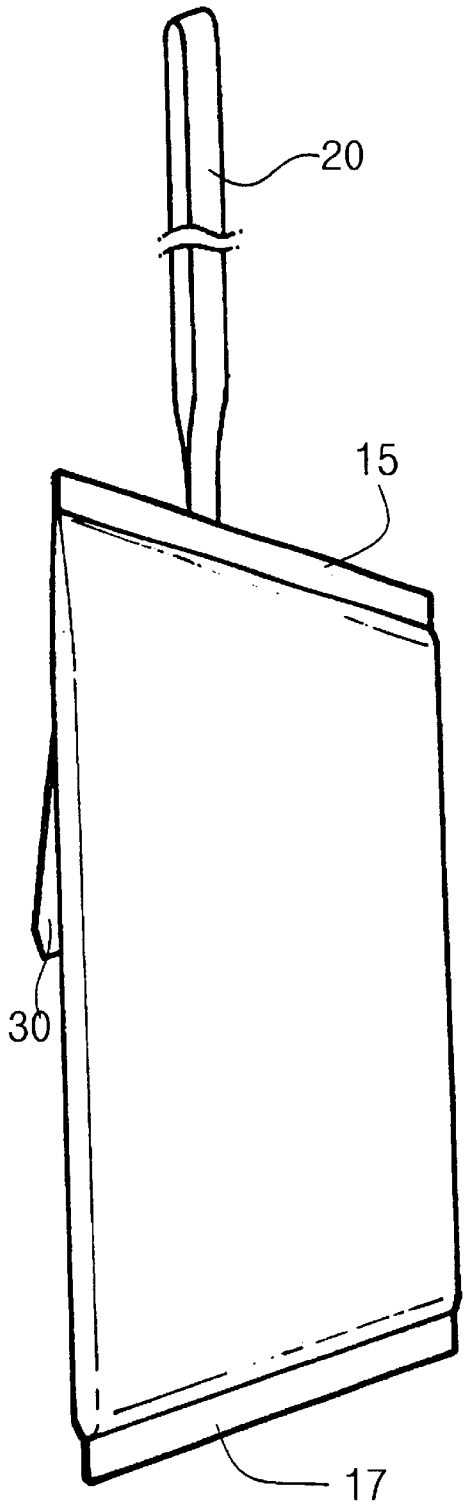
FIG. 1 is a perspective view for explaining the structure of a cookie packing container having a hanger according to a first embodiment of the present invention.
Figure 2:
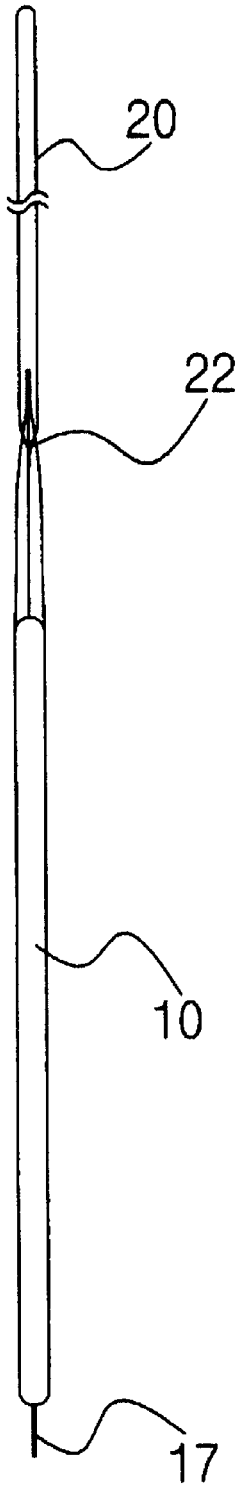
FIG. 2 is a side view for explaining the structure of a cookie packing container according to the first embodiment of the present invention.
Figure 3:
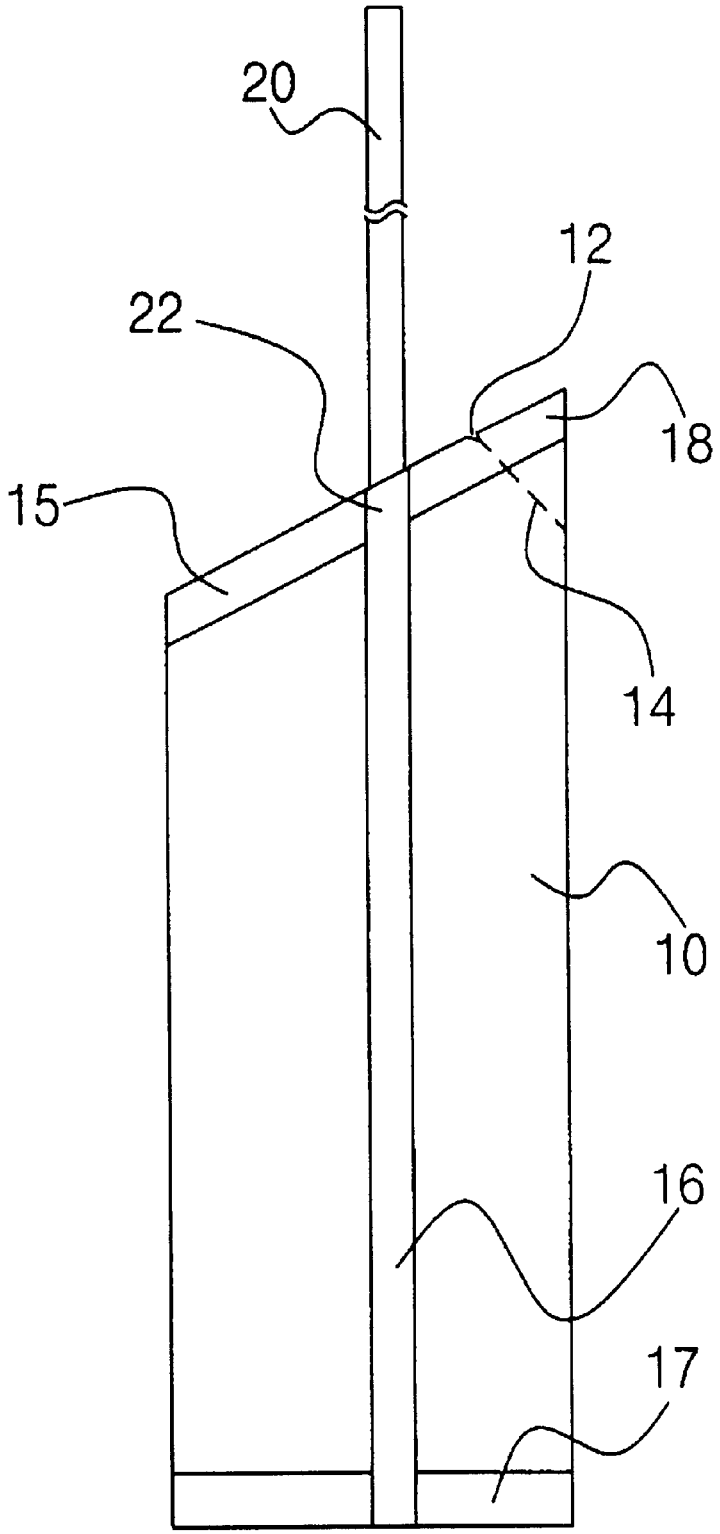
FIG. 3 is a front view for explaining the structure of a cookie packing container according to the first embodiment of the present invention.

As shown in FIGS. 1 through 3, a cookie packing container according to a first embodiment of the present invention includes a packing container body 10 both inner angles of one end of which are perpendicular to each other and on the other end of which is formed a peak portion 18, when the cookie packing container is folded, a longitudinal seaming portion 16 formed by seaming both side ends of the packing sheet along the lengthy direction of the packing container body 10, a lower-end seaming portion 17 formed by seaming the lower end of the packing container body 10 and an upper-end seaming portion 15 formed by seaming the upper end of the packing container body 10, and a hanger 20 one end of which is attached to one side of the packing container body 10, for allowing a user to hang the packing container body 10 in part of the human body, that is, in the neck.

The packing container body 10 is fabricated using a polymer synthetic resin such as polyethylene, polypropylene, and poly-vinyl. The longitudinal seaming portion 16, the lower-end seaming portion 17 and the upper-end seaming portion 15 are seamed in a method such as a high-frequency heating method.

One end of the hanger 20 is seamed at the same time when the longitudinal seaming portion 16 is seamed in a high-frequency heating method, to thereby form a fixing portion 22.

Figure 7:
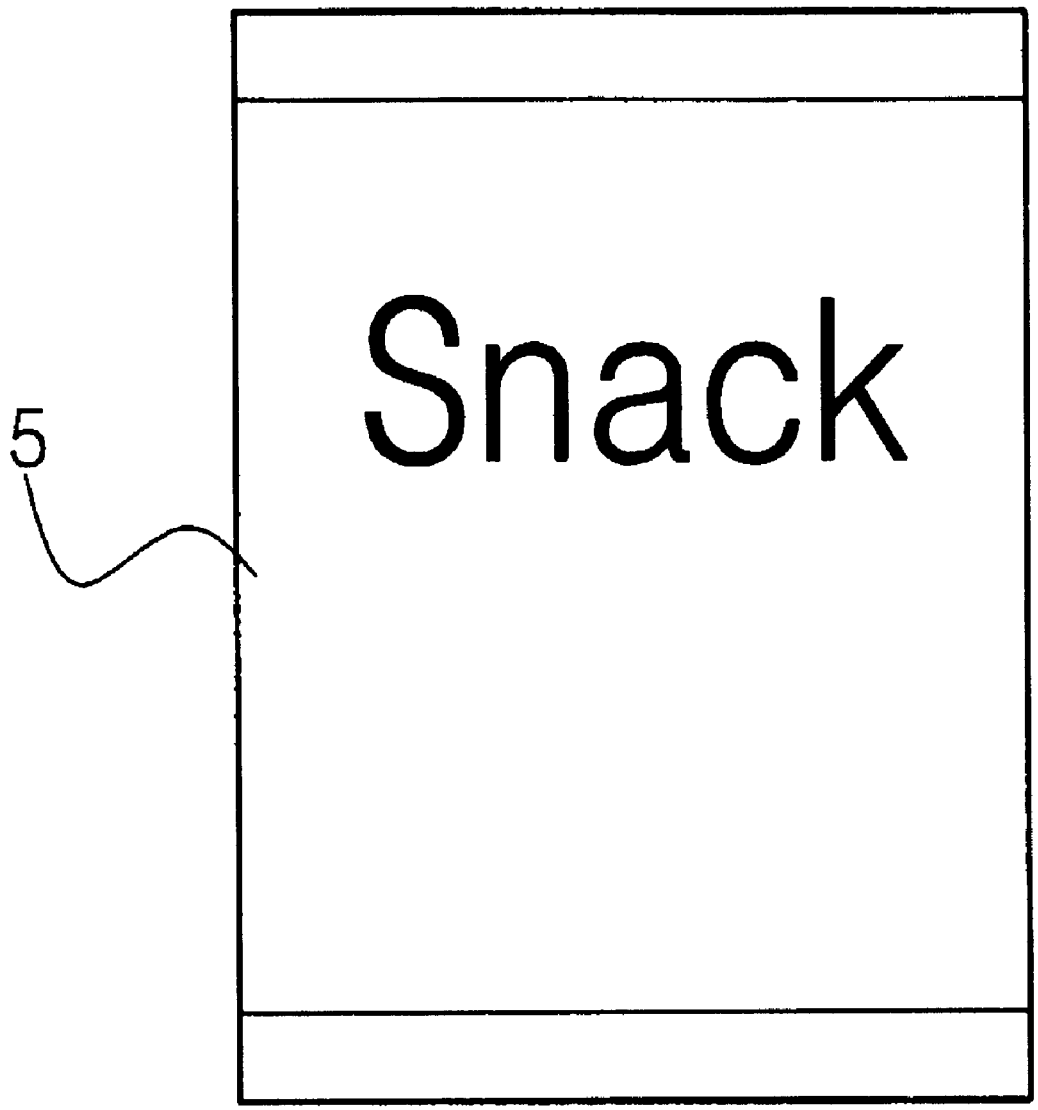
FIG. 7 PRIOR ART
FIG. 7 is a front view for explaining a conventional cookie packing container.

When the cookie packing container of the present invention is compared with the existing packing container 5 as shown in FIG. 7, the length of the packing container body 10 is relatively longer than the width thereof. A peak portion 18 is formed on the upper-end seaming portion 15.

To form the peak portion 18 as described above, the peak portion 18 is formed to have a slope of a predetermined angle with respect to the horizontal direction of the lower-end seaming portion 17, so that the peak portion 18 is formed on one end of the packing portion at a position facing the lower-end seaming portion 17.

As being the case, the peak portion 18 is formed on the central portion of the upper end of the packing container body 10, in which slopes are formed upward and toward the central portion from both sides of the upper-end of the packing container.

Meanwhile, the reason why the peak portion 18 is formed on the upper-end of the packing container body 10 and a cut-off portion 12 is formed in the peak portion 18 is as follows.

An actual size of a cookie packing container according to the present invention has the width of 10–11 cm and the length of 20–30 cm. A slope angle in the upper end thereof is about 30° with respect to the horizontal line of the lower end thereof.

Thus, the peak portion 18 formed on the upper end forms an angle of about 60° with respect to the vertical line of the lower end thereof. Thus, when a user cuts off the packing container using the cut-off portion 12 formed on the peak portion 18, he or she can eat the contents in the packing container body 10 through the mouth contacting the cut-off portion easily.

Meanwhile, since a hanger 20 is provided in one end of the packing container body 10 having the above-described structure, that is, on the upper-end seaming portion 15 or on the upper end portion of the longitudinal seaming portion 16, cookies contained in the packing container can be eaten with the packing container hanged in the neck through the hanger 20, to thereby prevent the contents from pouring out due to a falling of the packing container, and allow a user to eat the contents conveniently.

Figure 4:
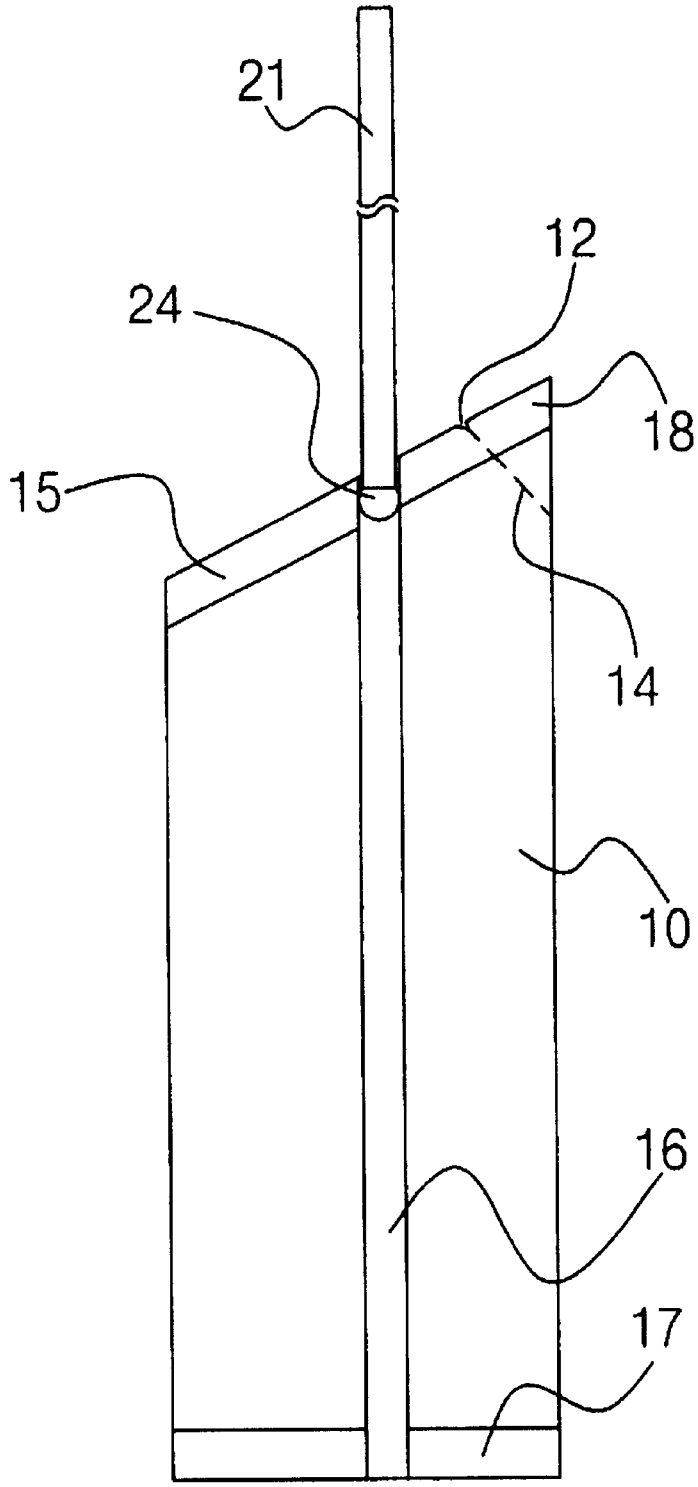
FIG. 4 is a front view for explaining the structure of a cookie packing container according to a second embodiment of the present invention.

The hanger 20 is made of a tape-shaped strip formed of the same material as that of the packing container body 10, that is, a synthetic resin film. In FIGS. 1 through 3, the present invention has been described with an example that the hanger 20 is attached to one end of the packing container body 10. In a second embodiment shown in FIG. 4, a hanging hole 24 is formed in the upper-end seaming portion 15 of the packing container body 10. A loop-shaped ring-type hanger 21 is coupled to the hanging hole 24.

Figure 5:
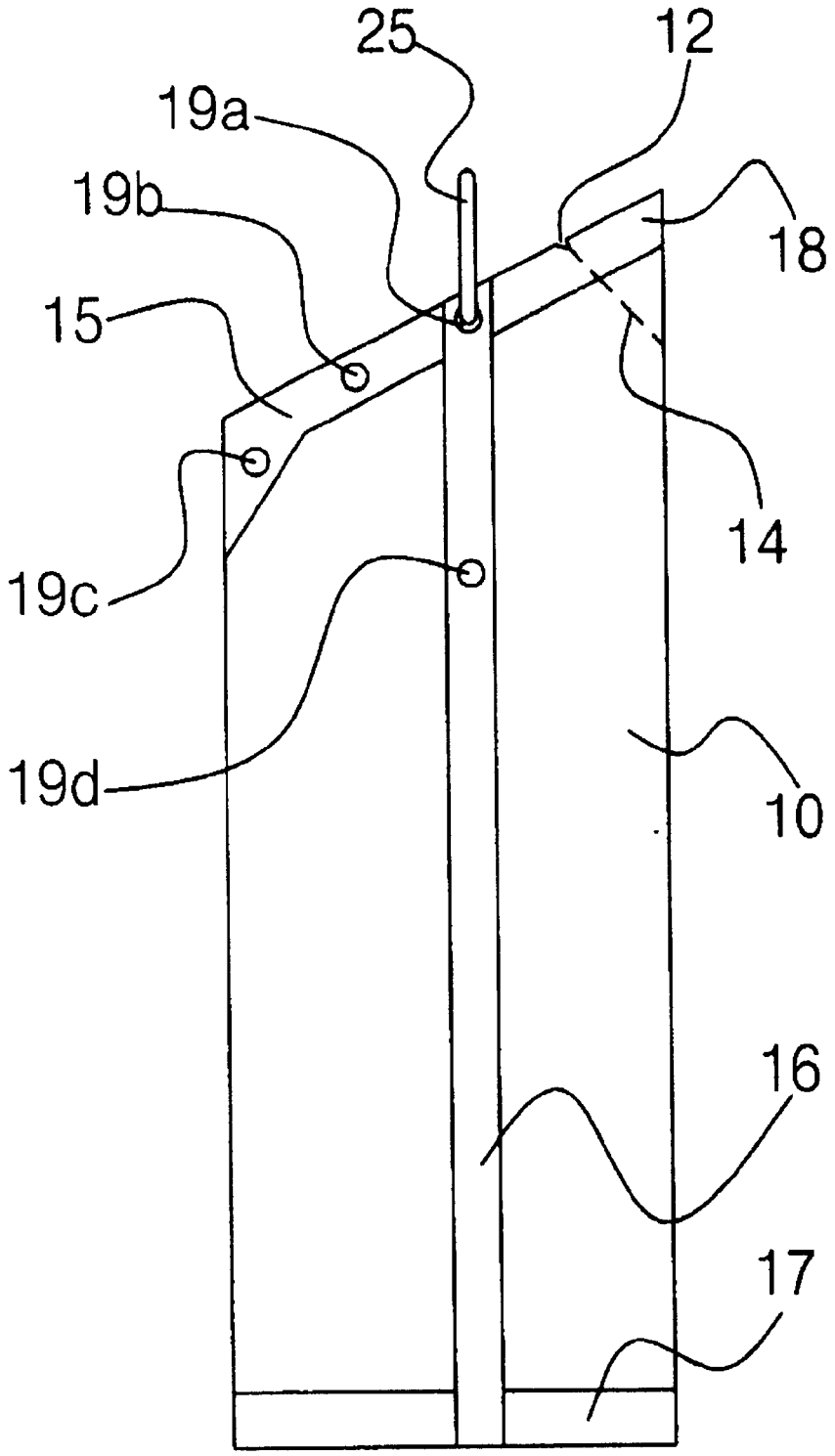
FIG. 5 is a front view for explaining the structure of a cookie packing container according to a third embodiment of the present invention.
Figure 6:
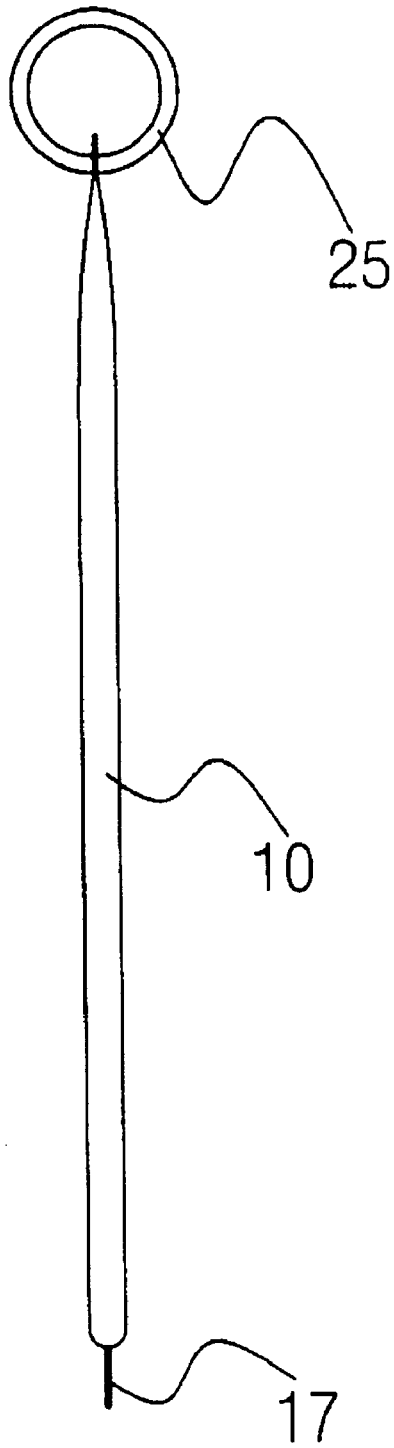
FIG. 6 is a side view for explaining the structure of a cookie packing container according to the third embodiment of the present invention.

Meanwhile, in a third embodiment of the present invention shown in FIGS. 5 and 6, a ring 25 is coupled to any one coupling hole among a plurality of coupling holes 19*a*, 19*b*, 19*c* and 19*d* formed in the upper-end seaming portion 15 or the longitudinal seaming portion 16. The ring 25 is a detachable and fittable ring. The ring 25 is coupled to any one coupling hole selected among a plurality of coupling holes 19*a*, 19*b*, 19*c* and 19*d*, according to a user necessity. A separate hanging strip is connected to the ring 25, to thereby allow a user to hang the packing container in part of the human body, that is, in the neck to carry it.

As described above, since the peak portion is formed on the upper end of the packing container, part of the peak portion is cut off when the contents are picked up and eaten, to thereby allow users to pick up and eat the contents simply without using a separate tool or hand, and since a hanger is provided in the cookie packing container, a user hangs the packing container in the neck during eating the contents conveniently to thereby allow a user to eat the cookies. As a result, the present invention prevents the contents from pouring out during eating.

As described above, the present invention has been described with respect to the particularly preferred embodiments. However, the present invention is not limited in the above-described embodiments. It is apparent to one who is skilled in the art that there are many variations and modifications, within the technical scope of the appended claims without departing off the spirit of the present invention.

What is claimed is:

1. A cookie packing container having a hanger comprising:

a packing container having a longitudinal seaming portion formed by using a planar packing sheet and searing both side ends of the packing sheet along the length direction of the packing container, a lower-end seaming portion formed by seaming the lower end of the packing sheet, an upper-end seaming portion formed by seaming the upper-end of the packing sheet, and cookies contained in said seamed packing container, the upper-end seaming portion having an upward slope of a predetermined angle with respect to the horizontal direction of the lower-end seaming portion to form a peak portion formed on the upper end of the packing container; and a hanger attached to the packing container, and dimensioned for hanging the packing container around the neck of a consumer;

the peak portion being dimensioned such that upon cutting off a part of the peak portion to form an open mouth of the packing container, the consumer can easily pick up and eat the contents of the packing container through the mouth while the packing container hangs around the neck to thereby prevent the contents from falling out due to a falling of the packing container.

2. The cookie packing container of claim 1, wherein a cut-off portion is formed adjacent to the peak portion.

3. The cookie packing container of claim 1, wherein said peak portion is formed on one side of the upper-end seaming portion.

4. The cookie packing container of claim 1, wherein said peak portion is formed on the central portion of the upper-end seaming portion.

5. The cookie packing container of claim 1, wherein said hanger is seamed and fixed at the same time when the upper-end seaming portion or the longitudinal seaming portion is seamed.

6. The cookie packing container of claim 1, wherein said hanger is connected and combined in a hanging hole formed in the upper-end seaming portion.

7. The cookie packing container of claim 1, wherein at least one coupling hole is formed in at least one portion of the longitudinal seaming portion and the upper-end seaming portion, in which a ring connected to the coupling hole is further provided, and said hanger is connected to the ring.

8. The cookie packing container of claim 7, wherein said ring is made of a fittable ring which can be detachable from the coupling hole.

* * * * *